United States Patent [19]

Orsinger et al.

[11] 4,177,979

[45] Dec. 11, 1979

[54] SIGNATURE GATHERING MACHINE

[75] Inventors: Winston A. Orsinger, Nazareth; George Fallos, Easton, both of Pa.

[73] Assignee: Bell & Howell Company, Phillipsburg, N.J.

[21] Appl. No.: 880,525

[22] Filed: Feb. 23, 1978

[51] Int. Cl.[2] ..... B65H 39/045

[52] U.S. Cl. ..... 270/54

[58] Field of Search ..... 270/54–58

[56] References Cited

U.S. PATENT DOCUMENTS

| | | | |
|---|---|---|---|
| 2,621,039 | 12/1952 | Kleineberg | 270/54 |
| 3,809,385 | 5/1974 | Rana | 270/54 |

*Primary Examiner*—Edgar S. Burr
*Assistant Examiner*—A. Heinz
*Attorney, Agent, or Firm*—Griffin, Branigan & Butler

[57] ABSTRACT

A signature gathering machine (14) comprises a plurality of hoppers (16) which can be randomly spaced relative to one another and to collating chain pusher pins (30 *a,b,*etc). The hoppers (16) can be moved to various positions along a frame 70 and fixed in place at those positions. An adjustable power linkage (FIGS. 3–5 and 7) to the hoppers allows the respective synchronization of the hoppers to be set relative to the collating chain pusher pins for new positions.

10 Claims, 7 Drawing Figures

Fig. 2
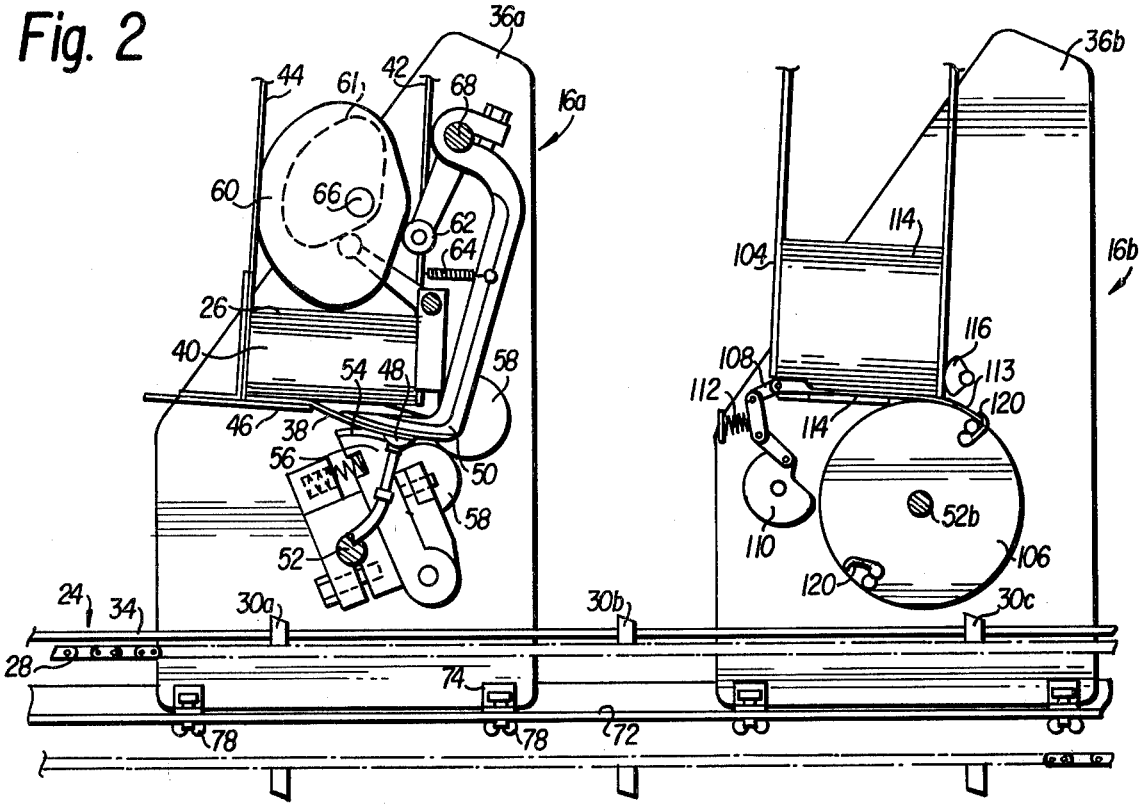
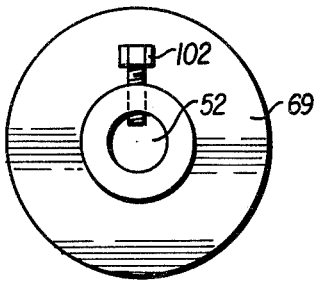
Fig. 7
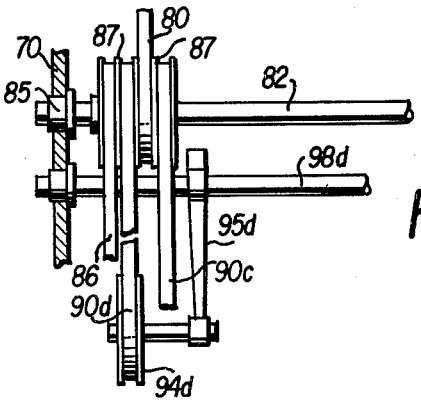
Fig. 4
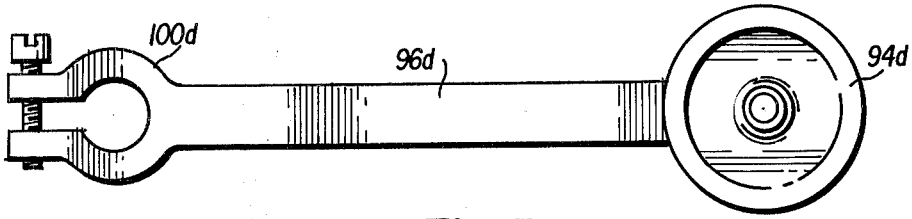
Fig. 5

SIGNATURE GATHERING MACHINE

This invention relates broadly to signature gathering machines and more particularly to such machines having pluralities of hoppers positioned along sheet conveyers for dispensing signatures, or inserts, onto the conveyers.

Signature gathering machines are known which include sheet conveyers adjacent to pluralities of hoppers and having pluralities of pin sets placed therealong to receive and push signatures, or inserts, deposited thereon from the hoppers. Until recent years, the hoppers of such machines have normally acted in phased relationships. That is the hoppers have all dispense simultaneously with sets of pins being properly positioned to receive signatures from respective hoppers at the same time. In this regard, the spacing between the conveyer pin sets has normally been the same as the spacing between the hoppers. A difficulty with this arrangement is that when all of the mechanical parts, such as cams, cranks, and the like move simultaneously, they cause undue pulsating and jerky operation. Jerky operation can result from cams straining to move during a part of the drive cycle and racing at the end of the drive cycle as well as from other things. Such operation causes undue wear and vibrations and is unpleasant for operators. Thus, it is an object of this invention to provide a signature gatherer which is not unduly jerky in operation and which provides smooth and continuous types of motions.

It is suggested in U.S. Pat. No. 3,825,247 to Fernandez-Rana to space conveyer pins a distance which is less than the distance between hoppers and to dephase adjacent hoppers with respect to each other. Thus, if there are four hoppers, this patent suggests operating two of them out of phase with the other two. A similar suggestion is made in U.S. patent application Ser. No. 569,989 filed on Apr. 21, 1975 by Wilbur J. Morrison, et al., now U.S. Pat. No. 4,079,576. Although these teachings do provide an improvement over the prior art, they still have the difficulty of the prior art that the phase settings of the various hoppers must be preset for a particular number of hoppers, the locations of the pins, and the speed at which the conveyer travels. Thus, the phases cannot be randomly set if, for example, fewer or more hoppers are used. It is therefore an object of this invention to allow totally random dephasing of hoppers which is independent of the number of hoppers, conveyer pin spacing and conveyer speed.

Yet another object of this invention is to provide a signature gathering machine which allows hoppers to be moved to various positions in order to position additional elements between the hoppers when it is so desired and to allow using an optimum number of hoppers depending upon the specific requirements of a user.

Another object of this invention is to provide a signature gathering machine which allows the use of more than one type of signature feed hopper, thus allowing an operator to combine the advantages of several types of signature feed hoppers in a single signature gathering machine.

SUMMARY

According to principles of this invention, the positions of hoppers on a signature gathering machine can be varied and their dispensing times phased to their new positions. Thus, an infinite number of dispensing phase possibilities are available for each hopper for a fixed pin spacing and speed and for diverse types of hoppers by varying the hoppers' positions.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 2 is a sectional view of two diverse-types of hoppers of the in-line inserting machine of FIG. 1;

FIG. 4 is a fragmented view of a portion of the linkage of FIG. 3;

FIG. 5 is an enlarged view of a linkage element of FIG. 4;

FIG. 7 is an enlarged fragmented view of a linkage element of FIG. 4.

DESCRIPTION OF THE PREFERRED EMBODIMENT

Figure 1:
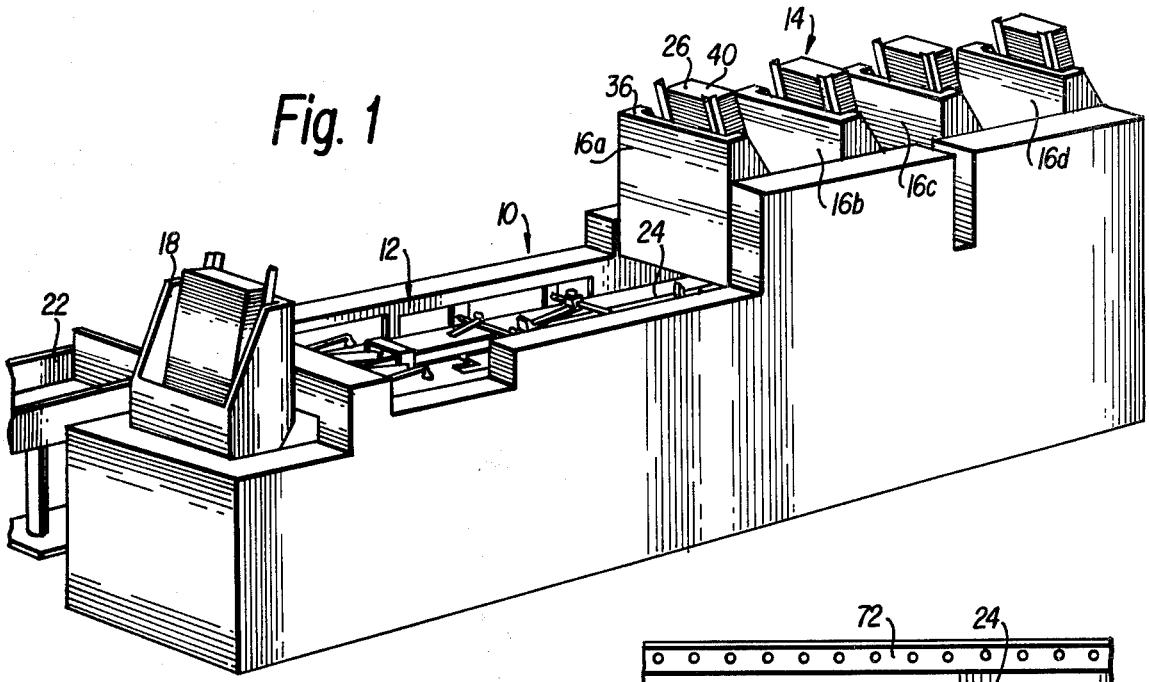
FIG. 1 is an isometric view of an in-line inserting machine having a hopper arrangement according to principles of this invention.

An in-line inserter assembly 10 (FIG. 1) basically comprises independently-operating, but cooperating, sub-systems as follows: A stuffing station 12, with associated structure; an insert (or signature gathering) system 14 for furnishing inserts, or signatures, from signature hoppers 16 *a–d* and conveying them toward the stuffing station 12; an envelope system 18 for furnishing envelopes from an envelope hopper 20 and conveying them toward the stuffing station 12 at which the envelopes are mated with the signatures or inserts; and a sealing and stacking system 22 which handles stuffed envelopes.

The overall operation of this machine is described in detail in application Ser. No. 569,989 filed Apr. 21, 1975 by Wilbur J. Morrison et al., now U.S. Pat. No. 4,079,576, and the material in that patent is hereby incorporated by reference herein. This invention concerns specifically the insert (or signature gathering) subsystem 14 shown in the drawings. Other signature gathering systems with which this invention could be used are described in U.S. Pat. No. 3,423,900 to Orsinger and U.S. Pat. No. 3,825,247 to Fernandez-Rana.

Figure 6:
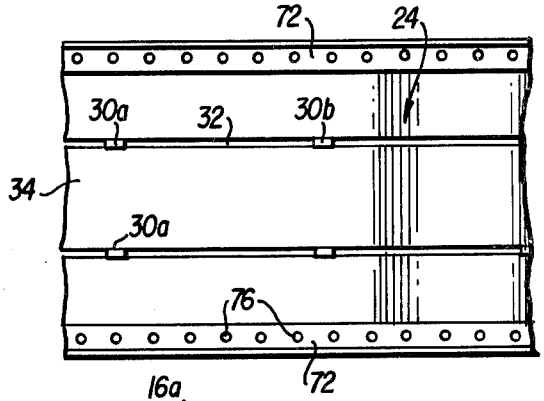
FIG. 6 is an isometric view of a fragmented portion of a conveyer of the in-line inserting machine of FIG. 1.

The insert (or signature gathering) system 14 is basically comprised of a sheet conveyer 24 (FIGS. 1, 2 and 6) having the signature hoppers 16*a–d* positioned thereabove for dropping signatures 26 and 114 from the hoppers onto the sheet conveyer 24. In this respect, the sheet conveyer 24 comprises endless chains 28 carrying pairs of pins 30*a*, 30*b*, etc., in slots 32 of a stationery conveying surface 34.

The signature hoppers 16*a–d* each includes a housing 36 enclosing apparatus for holding a stack of signatures and for dispensing these signatures, one at a time, from the hopper onto the sheet conveyer 24. In this respect, each of these hoppers, in the FIGS. 1-3 embodiment, may include a pull-foot sheet feeding device as is described in detail in U.S. Pat. Nos. 4,013,283 and 4,060,228 to Tress and Orsinger and/or a rotary feeder as is described in U.S. Pat. No. 3,423,900 to Orsinger. In this respect, U.S. Pat. No. 4,060,228 describes a modification of the pull-foot sheet feeding system of U.S. Pat. No. 4,013,283 and this modification is the type of system employed as hopper 16*a* in the illustrated embodiment of the present invention. The subject matter described in those patents is hereby incorporated by reference herein.

Broadly, the various pull-foot elements are mounted in the housing 36. Describing the operation of one pull-foot feeding mechanism 16*a* generally, but noting that the hoppers 16*c* and *d* include identical pull-foot feeding mechanisms and that more detail can be found in the above incorporated-by-reference patents, a bottom-most sheet 38 (FIG. 2) in a sheet stack 40 (which is supported by a vertical front plate 42, a vertical rear plate 44, and a bottom plate 46) is separated from the sheet stack 40 by a reciprocating suction cup 48 and pull-feet 50 (there are two, but only one can be seen in the drawings) enter the space between the sheet stack 40 and the bottom-most sheet 38 as is depicted in FIG. 2. At this point a driving shaft 52 is at a position such that friction surfaces 54 (two) on roller segments (two) 56 clamp the bottom-most sheet 38 between the friction surfaces 54 and the pull-feet 50. The pull-feet 50 are driven outwardly, in a counterclockwise direction as seen in FIG. 2, by the roller segments 56 with the bottom-most sheet 38 being carried between the friction surfaces 54 and the pull-feet 50. Eventually, the bottom-most sheet is gripped by driven transfer rolls 58 and are transported away from the sheet stack 40.

When the transfer rolls 58 have gripped the bottom-most sheet 38 a cam 60 catches up to a cam follower 62 and controls the pull-feet 50 to avoid fouling of the sheet 38 that was gripped by the transfer rolls 58. Thereafter, the roller segments 56 are rotated a full revolution by the driving shaft 52 to return to a position for clamping the next bottom-most sheet between them and the pull feet.

The pull-feet 50 are held outwardly by the cam 60 until the next bottom-most sheet 38 is separated from the sheet stack 40. At this point the cam 60 allows a spring 64 to pull the pull-feet 50 between the next bottom-most sheet 38 and the sheet stack 40. An additional cam 61 and a separator foot 63 also aid in separating bottom-most sheets from the sheet stack 40 as is described in the incorporated by reference patents.

All of the necessary shafts for operating the pull-foot sheet feeding mechanism of each of the signature hoppers 16*a -d* are mounted in a housing 36*a-d*. That is, the driving shaft 52, a cam shaft 66, a pull-foot shaft 68 and transfer rolls 58 are all mounted for rotation in the housing 36 so that each hopper forms an integral unit. Power is introduced to the pull-foot feed mechanism by means of a pully 69*a-d* (FIG. 3) attached to the driving shaft 52 and timing belts transfer this energy to the cam shaft 66 and the transfer rolls 58.

It can be readily appreciated by those skilled in the art that operation of the cams 60 and 61 and the pull feet 50 create vibrations and sometimes result in somewhat jerky or pulsating operation of the feeder mechanisms in particular and the in-line inserter assembly 10 generally. Where the cams of each of the signature hoppers are synchronized, this jerkiness is accentuated in that, for one thing, the cams labor and race at the same time. Also, the pull-feet moving together cause reinforced vibrations. It is noted that this same problem usually exists with other types of sheet feeding mechanisms as well as will be further pointed out below with regard to a rotary feeder of hopper 16*b*.

To reduce this problem, the hopper housings 36 are each movably mounted along a frame 70 on which the sheet conveyer 24 is supported. In this respect, the frame 70 includes angle irons 72 positioned on opposite sides of the conveyor 24 on which feet 74 of the hopper housings 36 rest. The angle irons 72 have appartures 76 in horizontal surfaces thereof on which the feet 74 rests and to which the feet 74 are bolted to hold the insert hoppers 16*a -d* in fixed positions. The hoppers' positions can be changed by removing bolts 78 in the feet 74, moving the housings 36 to new positions, and fastening the bolts through new appatures 36. It should be noted by comparing FIGS. 2 and 6 that the distances between adjacent apertures 76 is much less than the widths of the hoppers 16, thereby allowing fine adjustments of the hoppers' 16 positions along the frame 70 to achieve smooth operation of the system 16.

Figure 3:
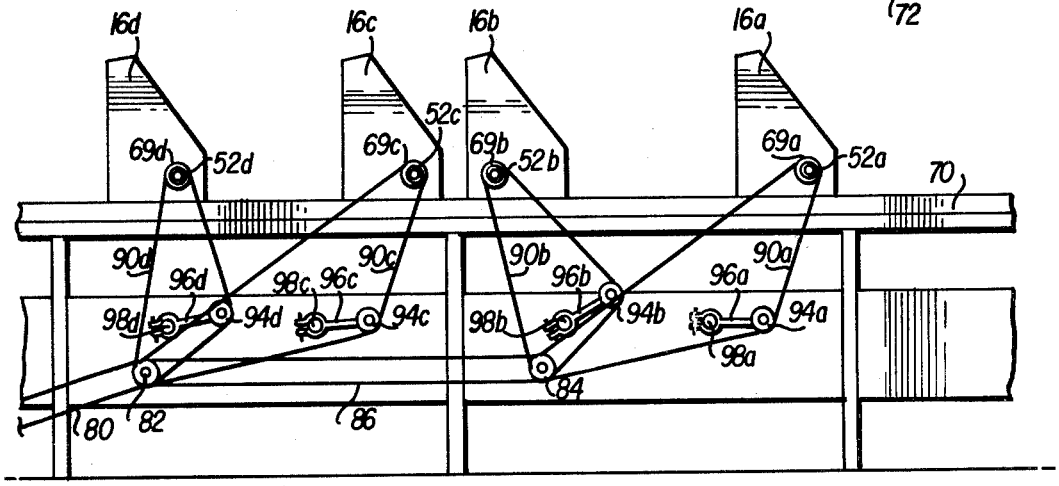
FIG. 3 is a fragmented diagrammatic view depicting the power linkage to the hoppers of the in-line inserting machine of FIG. 1.

Concerning the manner in which power is supplied to the randomly spaced signature hoppers 36*a-d*, with reference to FIG. 3, a main timing belt 80 provides power to an idler shaft 82 which, in turn, provides power to an idler shaft 84 via a pulley and a timing belt 86. In this respect, the pulleys are fixedly attached to the idler shafts 82 and 84 and these shafts are mounted for rotation on the frame 70 by a suitable means such as bearings. All of the timing belts mentioned herein, and the pulleys associated therewith, are toothed so as to assure synchronous motion between the various elements. Also attached to each of the idler shafts 82 and 84 are auxiliary pulleys 87 for engaging auxiliary timing belts 90*a-d*. The auxiliary timing belts 90*a-d* each engages one of the drive pulleys 69*a-d* which is respectively attached to a driving shaft 52*a-d* of a signature hopper 16*a-d* as was explained above.

Take-up idler pulleys 94*a-d* are mounted on arms 96*a-d*, which, in turn, are mounted on fixed shafts 98*a-d*. In this respect, the arms 96*a-d* are respectively attached to the fixed shafts 98*a-d* by means of clamps 100*a-d* which can be selectively loosened to move the take-up pulleys 94*a-d* to any angular position desired about the fixed shafts 98*a-d*. The take-up pulleys 94*a-d* are mounted for rotation on the arms 96*a-d*. Thus, when any of the signature hoppers 16*a-d* is moved to new appatures 76 along the angle irons 72 by selectively loosening the bolts 78, the belt drive system to that signature hopper can also be adjusted by loosening a clamp 100*a-d* and moving its respective take-up pulley 94*a-d*. In this manner, the appropriate auxiliary timing belt 90*a-d* can be adjusted to the proper tension no matter where the signature hopper 16*a-d* is moved along the frame 70.

The main timing belt 80 is synchronized to movement of the endless chain 28 and the pins 30 attached thereto (interconnecting linkages not shown), so that the signature hoppers 16*a -d* dispense at the correct times to deposit signatures in front of the pins 30. However, when the signature hoppers are moved to new locations, they must be resynchronized to their new locations. To accomplish this, the driving pulleys 69*a-d* are selectively disengaged from their respective driving shafts 52 and the associated feed mechanisms thereafter driven by hand until they are in a proper sync-relationship with an appropriate pin pair 30*a, b,* etc. Thereafter, the driving pulleys 69*a–d* are again fixed onto the driving shafts 52. Such selective engagement and disengagement is accomplished in the illustrated embodiment by means of screws 102 (FIG. 7), however, other means can also be used.

It should be understood by those skilled in the art that this random spacing of signature hoppers allows an operator to adjust the phase relationships of any number of hoppers to any desired phased spacing. The operator can thereby adjust a signature gatherer to perform more smoothly than similar prior art devices. In addition, it will be appreciated by those skilled in the art that this variable spacing arrangement has the secondary benefit of allowing the spacing to be set for the addition of elements such as special reject and staging mechanisms which can be placed between the insert hoppers.

As is mentioned above, one aspect of this invention is that it allows the use of diverse types of insert hoppers 16*a–d*. For example, as is depicted in FIG. 2, in one embodiment, the hopper 16*b* is a rotary hopper while the hopper 16*a* is a pull foot-type hopper. The rotary hopper 16*b* basically includes a magazine 104, a rotary feed or transfer drum 106, and appropriate substructures as are further described below.

With regard to the magazine 104, associated therewith is a signature pusher 108, a rotary cam 110, and a compression spring 112. The signature pusher 108 is mounted on the magazine 104 to be reciprocated by lever linkages including the rotary cam 110 and the compression spring 112 adjacent to the bottom of the magazine 104. In this respect, the signature pusher 108 engages edgewise successive lowermost signatures 113 and advances the signatures over a bottom gate 114 of the magazine 104 to extend substantially beyond the opposite edge of the bottom gate 114. Synchronized with the extension of each of the successive lowermost signatures 113 is a rotary deflector cam 116 which presses the leading margin of the signature against the perimeter of the rotary feed drum 106. The rotary feed drum 106 is mounted for rotation on the shaft 52*b*. Synchronization of continuous rotary movement of the rotary feed drum 106 with the signature pusher 108 is such that as the leading margin of each of the lowermost signatures 113 engages the rotary feed drum 106 it is engaged by a gripper 120 on the drum by which the card is clamped onto the drum for onward movement therewith. For high speed operation a plurality of grippers 120 is provided on the drum at suitable circumferential intervals, in this instance two such grippers are shown as located at diametrically opposite portions of the drum perimeter. This structure is described in greater detail in U.S. Pat. No. 3,423,900 to Orsinger and that description is incorporated by reference herein. In any event, the grippers 120 are synchronized to grip signatures once they are received from the magazine 104 and to open to release the signatures onto the sheet conveyer 24 to be pushed by a sets of pins 30*a, b,* etc. It should be understood that additional supporting apparatus could be used with the rotary-type signature hopper 16*b* as is further described in U.S. Pat. No. 3,423,900.

The various shafts of the rotary feed drum 106, the cam 110, and the grippers 120 are interconnected by means of toothed timing belts, cams, linkages, etc. Again, the reader is referred to U.S. Pat. No. 3,423,900 for details.

Energy is applied to the signature hopper 16*b* on the shaft 118 by means of an adjustable pulley 69 of the type depicted in FIG. 7. Thus, the pulley 69 can be released from the shaft 118 by loosening the screw 102 for allowing the rotary-type hopper 116*b* to be moved to a new location and synchronized with the other hoppers and pin 30 *a, b, c,* etc. speed.

It will be understood by those skilled in the art that this invention particularly allows the use of these diverse types of hoppers by allowing an infinite adjustment of the phases at which the cams and linkages of the diverse types of hopppers can operate.

While the invention has been particularly shown and described with reference to preferred embodiments, it will be understood by those skilled in the art that various changes in form and detail may be made therein without departing from the spirit and scope of the invention. For example, this invention could be used with other types of signature feeding devices than the pull-foot and rotary type described herein. However, it is thought that the pull-foot and rotary mechanisms are particularly well suited for this invention because all of the moving parts thereof can be easily mounted within a single insert frame.

While present preferred embodiments of the invention have been illustrated and described herein, it may be otherwise embodied and practiced within the scope of the following claims.

We claim:

1. A signature gatherer machine comprising:

a plurality of spaced hoppers arranged in a line, each hopper containing a stack of signatures;

a frame on which said hoppers are mounted, a signature conveyor having a plurality of spaced pockets positioned parallel to said line of hoppers;

each of said hoppers including a dispensing means for repetitively engaging a signature from its stack of signatures, separating said signature from other signatures in said stack, and delivering said signature to one of said pockets on said signature conveyer;

said frame including hopper-mounting means for mounting said hoppers on said frame at any of a plurality of overlapping positions which are offset from adjacent positions along said frame by a distance which is significantly less than the widths of said hoppers and for selectively allowing independent relative movement of said hoppers along said frame to all said overlapping positions for adjusting the overall operation of said signature gatherer machine;

a power source and a variable-length linkage means for providing power to said hoppers at all said overlapping positions, said variable-length linkage means having an adjustable variable effective length from said power source to each of said respective hoppers for providing power from said power source to each of said hoppers at all said overlapping positions to which said hoppers are movable.

2. A signature gatherer machine as in claim 1 wherein said dispensing means for each of said hoppers comprises a pull-foot feeding mechanism.

3. A signature gatherer machine as in claim 1 wherein said variable-length linkage means comprises toothed belts extending from a single power source to each of said hoppers.

4. A signature gatherer machine as in claim 3 wherein are further included laterally movable idlers for engaging said toothed belts to adjust the tension of said toothed belts when said hoppers are moved.

5. A signature gatherer machine as in claim 1 wherein said conveyer is mounted on said frame.

6. A signature gatherer machine as in claim 1 wherein said dispensing means for said hoppers are of mechanically diverse types.

7. A signature gatherer machine as in claim 6 wherein at least one of said dispensing means employs a reciprocating pull foot to deliver signatures from the hopper to the pockets on said signature conveyer and at least one other employs a rotating drum to deliver signatures from the hopper to the pockets.

8. A signature gatherer machine as in claim 1 wherein said variable-length linkage means includes a pulley and wherein said pulley can be detached from a shaft to adjust the synchronization of a particular hopper.

9. A signature gatherer machine as in claim 8 wherein said dispensing means for said hoppers are of mechanically diverse types.

10. A signature gatherer machine as in claim 9 wherein at least one of said dispensing means employs a reciprocating pull foot to deliver signatures from the hopper to the pockets on said signature conveyor and at least one other employs a rotating drum to deliver signatures from the hopper to the pockets.

* * * * *